US011028465B2

(12) United States Patent
Hu et al.

(10) Patent No.: US 11,028,465 B2
(45) Date of Patent: Jun. 8, 2021

(54) LOW-COST LEAD-FREE DEZINCIFICATION-RESISTANT BRASS ALLOY FOR CASTING

(71) Applicant: XIAMEN LOTA INTERNATIONAL CO., LTD, Xiamen (CN)

(72) Inventors: Zhenqing Hu, Xiamen (CN); Qiu Bi, Xiamen (CN); Jia Long, Xiamen (CN); Yuanhao Cheng, Xiamen (CN); Huawei Zhang, Xiamen (CN); Qing Lv, Xiamen (CN)

(73) Assignee: Xiamen Lota International Co., Ltd.

( * ) Notice: Subject to any disclaimer, the term of this patent is extended or adjusted under 35 U.S.C. 154(b) by 236 days.

(21) Appl. No.: 16/064,793

(22) PCT Filed: Dec. 21, 2016

(86) PCT No.: PCT/CN2016/111286

§ 371 (c)(1),
(2) Date: Jun. 21, 2018

(87) PCT Pub. No.: WO2017/107917

PCT Pub. Date: Jun. 29, 2017

(65) Prior Publication Data

US 2018/0371581 A1 Dec. 27, 2018

(30) Foreign Application Priority Data

Dec. 22, 2015 (CN) ..... 201510973804.4

(51) Int. Cl.
*C22C 9/04* (2006.01)

(52) U.S. Cl.
CPC ..... *C22C 9/04* (2013.01)

(58) Field of Classification Search
CPC ..... C22C 9/04; C22F 1/08
See application file for complete search history.

(56) References Cited

U.S. PATENT DOCUMENTS

2016/0215366 A1* 7/2016 Uchida ..... C22F 1/08

OTHER PUBLICATIONS

English Abstract and English Machine Translation of Jiade (CN 102312123) (Jan. 11, 2012).*
Zhang, Ai-Sheng, Ming-Ming Yan, and Qiu-Lian Zeng. "Effects of RE, Boron and Zirconium on Microstructures of HPb59-1 Brass." Foundry 10 (2005): 20.*

* cited by examiner

*Primary Examiner* — Jessee R Roe
(74) *Attorney, Agent, or Firm* — Lewis Roca Rothgerber Christie LLP

(57) ABSTRACT

A low-cost lead-free dezincification corrosion-resistant brass alloy for casting. The brass alloy contains: 60-65 wt. % of Cu, 0.05-0.25 wt. % of Pb, 0.05-0.8 wt. % of Al, 0-0.1 wt. % of Sn, and 0.05-0.16 wt. % of As, with the balance being Zn and inevitable impurities. Moreover, the equivalent weight of zinc X meets the requirements of the following formula: $35\%<X<39.5\%$, and $X=(B+\Sigma CiKi/(A+B+\Sigma CiKi)$; in the formula, X is the equivalent weight of zinc in the complex brass, A is the copper content (%), B is the actual zinc content (%), Ci is the content (%) of the other alloy elements, and CiKi is the corresponding equivalent weight of zinc of various elements.

16 Claims, No Drawings

LOW-COST LEAD-FREE DEZINCIFICATION-RESISTANT BRASS ALLOY FOR CASTING

CROSS-REFERENCE TO RELATED APPLICATION(S)

This application is a National Phase Patent Application of International Patent Application Number PCT/CN2016/111286, filed on Dec. 21, 2016, which claims priority of Chinese Patent Application 201510973804.4, filed Dec. 22, 2015. The entire contents of both of which are incorporated herein by reference.

TECHNICAL FIELD

The present invention belongs to the technical field of alloys, particularly relates to an environmentally-friendly lead-free brass alloy, more specifically relates to a low-cost lead-free dezincification-resistant brass alloy for casting.

BACKGROUND OF THE INVENTION

It is well known that there exists selective corrosion (i.e., dezincification phenomenon) during use of brass, therefore as an important index of the brass alloy material, the superior dezincification corrosion resistance is very important for improving the service life of parts or equipment. The normal copper alloys containing lead exhibit low dezincification corrosion resistance, for example, the average dezincification layer depth of the lead copper CuZn39Pb1Al is greater than 400 μm. As for dezincification-resistant capacity of brass products, it is generally accepted internationally the AS 2345 standard, that is the average dezincification layer depth of brass products should not exceed 100 μm.

There are two main problems existing in the dezincification corrosion resistance brass on the market:

High lead content: the widely used DR brass for casting CuZn35Pb2Al on the market contains Pb with a content of 1.5-2.2 wt. %.

High copper content: some known copper alloys, such as H85A, H70A and C69300, do not contain Pb, which meet the requirement for environmental protection, however, the cost of the copper alloys is high because of their high copper content.

The brass alloy with low copper content is mainly composed of α+β two-phase brass. The addition of As can significantly improve its dezincification corrosion resistance. So far, there have been some patent applications claiming adding a certain amount of As to brass to improve its dezincification corrosion resistance.

Chinese patent application No. 201110389789.0 discloses a low lead corrosion resistant brass alloy for casting and the manufacturing method thereof, the brass alloy consists of 61.0-62.5 wt. % of Cu, no more than 0.2 wt. % of Pb, no more than 0.2 wt. % of Al, 0.35-0.55 wt. % of Bi, 0.15-0.22 wt. % of As, no more than 0.15 wt. % of impurities, and the balance being Zn.

PCT patent application No. WO/2001/014606 discloses a dezincification-resistant brass alloy for die-casting consisting of 63.0-65.0 wt. % of Cu, 1.5-2.2 wt. % of Pb, 0.6-0.9 wt. % of Si, 0.03-0.1 wt. % of Al, 0.03-0.1 wt. % of As, <0.5 wt. % of Ni, <0.5 wt. % of Sn, 0.1-0.5 wt. % of Fe, 0-15 ppm of B, <0.3 wt. % of the sum of other impurities, and the balance being Zn.

Chinese patent application No. 200910164116.8 discloses a low lead dezincification-resistant brass alloy consisting of less than 0.3 wt. % of Pd, 0.02 to 0.15 wt. % of Sb, 0.02 to 0.25 wt. % of As, 0.4 to 0.8 wt. % of Al, 1 to 20 ppm of B, more than 97 wt. % of Cu and Zn, wherein the content of Cu in the dezincification-resistant brass alloy is 58 to 70 wt. %.

Chinese patent application No. 200910171021.9 discloses a dezincification-resistant copper alloy and the manufacturing method thereof, wherein the brass alloy consists of 59.5 to 64 wt. % of Cu, 0.1 to 0.5 wt. % of Bi, 0.08 to 0.16 wt. % of As, 5 to 15 ppm of B, 0.3 to 1.5 wt. % of Sn, 0.1 to 0.7 wt. % of Zr, less than 0.05 wt. % of Pb, and the balance being Zn.

Chinese patent application No. 201010502728.6 discloses a dezincification-resistant brass alloy consisting of 0.5 to 1.2 wt. % of Si, 0.01 to 0.2 wt. % of Sb, 0.02 to 0.25 wt. % of As, 0.4 to 0.8 wt. % of Al, and more than 95.8 wt. % of Cu and Zn.

Lead will pollute the environment and threaten human health in the process of production and use. Developed countries and districts such as the United States and the European Union have successively formulate the standards and regulations, such as NSF-ANSI372, AB-1953, and RoHS and the like, to gradually prohibit producing, selling and using leaded products. Sb is toxic itself and is very easy to release in the process of use, and the release amount of Sb into water of the products such as the tap, valve and the like is far beyond the standard tested by NSF, therefore, the use of Sb exists hidden dangers for environment and human health. Bi is expensive, and has to be strictly separated from leaded brass and other metals in the scrap recycling chain, which is difficult to control. Zr is expensive, and very easy to combine with oxidizing mediums like oxygen, sulphur and the like to transfer into the slag, which cause great loss.

SUMMARY OF THE INVENTION

In order to overcome the drawbacks of the prior art, the invention provides a low cost lead-free dezincification-resistant brass alloy for casting. The brass alloy of the present invention has good comprehensive performance and can be used for producing components such as water taps, conduit joints and the like. The alloy of the present invention has excellent dezincification corrosion resistance, and its average dezincification layer depth is less than 100 μm. In addition, the alloy also has good castability, stress corrosion resistance, polishing performance and welding performance, is suitable for the components such as plumbing, bathroom and the like molded by sand casting and low pressure casting, especially for accessories such as water taps and the like working in poor environment condition.

The purpose of the present invention is achieved through the following technical solutions.

The present invention provides a low cost lead-free dezincification-resistant brass alloy for casting, wherein the brass alloy contains 60-65 wt. % of Cu, 0.05-0.25 wt. % of Pb, 0.05-0.8 wt. % of Al, less than 0.1 wt. % of Sn, 0.05-0.16 wt. % of As, with the balance being Zn and unavoidable impurities, and the zinc equivalent X meets the requirement of the following formula: $35\% < X < 39.5\%$, wherein $X=(B+\Sigma CiKi)/(A+B+\Sigma CiKi)$, in the formula, X is the zinc equivalent of the brass, A is the content of copper (%), B is the actual content of zinc (%), Ci is the content of other alloy elements (%), CiKi is the corresponding zinc equivalent of various elements.

Preferably, the content of Cu in the brass alloy is: 62-64 wt. %;

Preferably, the content of Pb in the brass alloy is: 0.1-0.25 wt. %;

Preferably, the content of Al in the brass alloy is: 0.1-0.4 wt. %;

Preferably, the content of As in the brass alloy is: 0.08-0.12 wt. %;

Preferably, the zinc equivalent X meets the requirement of following formula: 36%<X<39%.

Preferably, the brass alloy further comprises one or more elements selected from Ni, Fe, Si, P and B.

Preferably, the content of Ni in the brass alloy is: 0.05-0.5 wt. %, preferably 0.05-0.2 wt. %; the content of Fe is 0.02-0.2 wt. %, preferably 0.05-0.1 wt. %; the content of Si is 0.03-0.3 wt. %, preferably 0.05-0.2 wt. %; the content of P is 0.01-0.2 wt. %, preferably 0.05-0.1 wt. %; and the content of B is less than 0.01 wt. %, preferably 5-30 ppm.

The present invention further provides another low cost lead-free dezincification-resistant brass alloy for casting, wherein the brass alloy contains 60-65 wt. % of Cu, 0.05-0.25 wt. % of Pb, 0.05-0.4 wt. % of Al, 0.1-0.4 wt. % of Sn, 0.05-0.16 wt. % of As, with the balance being Zn and unavoidable impurities, and the zinc equivalent X meets the requirement of following formula: 35%<X<39%, wherein X=(B+ΣCiKi)/(A+B+ΣCiKi), in the formula, X is zinc equivalent in the brass, A is the content of copper (%), B is the actual content of zinc (%), Ci is the content of other alloy elements (%), CiKi is the corresponding zinc equivalent of various elements.

Preferably, the content of Cu in the brass alloy is: 62-64 wt. %;

Preferably, the content of Pb in the brass alloy is: 0.1-0.25 wt. %;

Preferably, the content of Al in the brass alloy is: 0.05-0.3 wt. %;

Preferably, the content of Sn in the brass alloy is: 0.1-0.3 wt. %;

Preferably, the content of As in the brass alloy is: 0.08-0.12 wt. %;

Preferably, the zinc equivalent X meets the requirements of following formula: 36%<X<38.5%.

Preferably, the brass alloy further comprises one or more elements selected from Ni, Fe, Si, P and B.

Preferably, the content of Ni in the brass alloy is 0.05-0.5 wt. %, preferably 0.05~0.2 wt. %; the content of Fe is 0.02-0.2 wt. %, preferably 0.05-0.1 wt. %; the content of Si is 0.03-0.3 wt. %, preferably 0.05-0.2 wt. %; the content of P is 0.01-0.2 wt. %, preferably 0.05-0.1 wt. %; and the content of B is less than 0.01 wt. %, preferably 5-30 ppm.

The present invention will be described in detail as blow.

The present invention provides a low cost lead-free dezincification-resistant brass alloy for casting, the brass alloy contains 60-65 wt. % of Cu, 0.05-0.25 wt. % of Pb, 0.05-0.8 wt. % of Al, less than 0.1 wt. % of Sn, 0.05-0.16 wt. % of As, with the balance being Zn and unavoidable impurities, and the zinc equivalent X meets the requirement of following formula: 35%<(B+ΣCiKi)/(A+B+ΣCiKi)<39.5%; or the brass alloy contains 60-65 wt. % of Cu, 0.05-0.25 wt. % of Pb, 0.05-0.4 wt. % of Al, 0.1-0.4 wt. % of Sn, 0.05-0.16 wt. % of As, with the balance being Zn and unavoidable impurities, and the zinc equivalent X meets the requirement of following formula: 35%<(B+ΣCiKi)/(A+B+ΣCiKi)<39.0%.

In the present invention, the low content of Cu makes the brass material low cost, the content of Cu is defined at 60-65 wt. %. If the content of Cu is too low, then the dezincification is poor. If the content of Cu is too high, then the cost is high, and the brass has poor castability and cuttability. Preferably, the content of Cu is 62-64 wt. %.

The addition of trace amount of Pb can improve the cuttability of the brass alloy, and also meets with AB1953 regulation, that is, the lead content of the material of parts of bathroom products should be less than 0.25 wt. %, and NSF61 regulation that is the release amount of Pb into water of single product of bathroom products should be less than 5 ppb.

The addition of Al can increase the fluidity of the alloy, improve its castability, and has solid solution strengthening effect, thereby improving the strength of the alloy. However, when the Al content is too high, the β phase will precipitate, thereby affecting the dezincification resistance performance.

The addition of Sn can enhance the corrosion resistance, improve the castability, and decrease the defects such as blowhole, porosity and the like in the casting, but the content of Sn should not be too high, otherwise the cost of the alloy will be increased and the dezincification corrosion resistance will also be weakened, furthermore, when the content of Sn in the alloy is above 0.1 wt. %, the zinc equivalent should be less than 39.0%, which can stabilize the dezincification corrosion resistance of the alloy.

The addition of trace amount of As can significantly improve the dezincification resistance of the alloy. However, the casting or forging cannot completely meet the requirements of AS 2345 only by adding arsenic, a certain heat treatment still be needed. In order to alleviate the tendency of dezinnation corrosion, the arsenic brass products are heated to the temperature above the α phase solubility curve to make the β phase dissolve into the α phase, then rapidly cooled to the temperature below the α phase solubility curve to perform the solid solution treatment to make all β phase disappear or change the distribution form of the β phase (from reticulation or strip to detached island). When the content of arsenic is too low, the dezincification-resistant performance cannot be improved significantly, when the content of arsenic is too high, the dezincification-resistant performance is not so good as that added the equivalent amount of As, the metal release is easy to exceed the standard. Preferably, the content of As is 0.08-0.12 wt. %.

One or more elements selected from Ni, Fe, Si, P and B may be added to the dezincification-resistant brass alloy according to the present invention. Wherein, Ni can increase the ratio of α phase and improve the corrosion resistance of the alloy; the addition of a proper amount of Si can significantly improve the cuttability and castability of the alloy, that's because that Si mainly dissolves in the β phase and makes the β phase brittle, thus, the chips are easily broken when the cutting tool meets the β phase in the process of cutting. However, Si has large zinc equivalent and high content of Si will harm the dezincification-resistant performance of alloys. Proper amount of Fe, P and B can refine the grains and improve the dezincification-resistant performance of the alloys, but the much higher content of Fe will affect the action on improving dezincification-resistance and polishing performance brought by As. Preferably, the content of Ni is 0.05-0.5 wt. %, the content of Fe is 0.02-0.2 wt. %, the content of Si is 0.03-0.3 wt. %, the content of P is 0.01-0.2 wt. %, and the content of B is <0.01 wt. %.

The most significant technical feature of the present invention is the introduction of zinc equivalent X=(B+ΣCiKi)/(A+B+ΣCiKi), in the formula, X is zinc equivalent in the brass, A is the content of copper (%), B is the actual content of zinc (%), Ci is the content of other alloy elements (%), CiKi is the corresponding zinc equivalent of various elements. The dezincification corrosion of brass is related to the zinc content in Cu—Zn alloy, when the zinc content is lower than 15 wt. %, the dezincification corrosion hardly occurs, but the erosion resistance of the alloy is poor, the increase of zinc content benefit to improve the strength and erosion resistance of the alloy, but increase the tendency of dezincification corrosion. When the zinc content of brass is more than 20 wt. %, the zinc element is easy to dissolve in the aqueous solution leaving the porous copper, which results in decreasing the strength of the brass, thereby greatly shortening the service life of the components working in the water. Therefore, the present invention defines the zinc equivalent of the alloy, only the above alloy formula is satisfied and the zinc equivalent is in a specific range (when the Sn content is less than 0.1 wt. % in the alloy, the zinc equivalent should be 35.0-39.5%, while the Sn content is above 0.1 wt. % in the alloy, the zinc equivalent should be 35.0-39.0%), the alloy has excellent dezincification-resistant performance and desirable castability.

The alloy according to the present invention has the characteristics of low cost, excellent dezincification corrosion resistance, good castability, good polishing and welding performance.

Specifically, compared with the prior art, the brass alloy according to the present invention at least possesses the following beneficial effects:

The brass alloy according to the present invention comprises no toxic elements such as cadmium, meanwhile, trace amounts of lead and arsenic are added, the release amount of the alloy elements into water meets the standard of NSF and AS/NZS 4020, therefore, the alloy is lead-free and environmentally friendly.

The brass alloy according to the present invention has excellent dezincification corrosion resistance, meets the requirements of AS 2345, and the average dezincification layer depth is ≤100 μm.

The copper content in the brass alloy according to the present invention is relatively low, and the raw material of the alloy is cheaper compared with the lead-free DR brass in the market.

DETAILED DESCRIPTION OF PREFERRED EMBODIMENTS

The technical solution of the present invention will be further illustrated with the following examples which given as below are only for clarifying the present invention, not for limiting the scope of the present invention.

Example 1

Table 1 shows the composition of the alloys according to the examples of the present invention, and table 2 shows the composition of Alloy 1~9 used for comparison, wherein, the Alloy 1 used for comparison is lead brass CuZn39Pb1Al and the Alloy 2 used for comparison is DR brass CuZn35Pb2Al.

The performance testing of the above examples and the alloys used for comparison are performed below. Specific testing items and basis are as follows:

1. Castability

Volume shrinkage test samples: The test samples were used for measuring the concentrating shrinkage cavity, dispersing shrinkage cavity and shrinkage porosity. If the face of the concentrating shrinkage cavity for volume shrinkage test samples is smooth, there is no visible shrinkage porosity, and there is no visible dispersing shrinkage cavity in the test samples' cross section, it indicates the castability is excellent, and will be shown as "O". If the face of the concentrating shrinkage cavity is smooth but the height of visible shrinkage porosity is less than 5 mm in depth in the bottom of the concentrating shrinkage cavity, there is no visible dispersing shrinkage cavity in the test samples' cross section, it indicates castability is good, and will be shown as "Δ". If the face of the concentrating shrinkage cavity is not smooth and the height of visible shrinkage porosity is more than 5 mm in depth in the bottom of the concentrating shrinkage cavity, it will be shown as "x".

Spiral test samples: The test samples were used for measuring the melt fluid length and evaluating the fluidity of the alloy.

Strip test sample: The test samples were used for measuring linear shrinkage of alloys.

2. Mechanical Performance

The mechanical performance of the alloys were tested according to GB/T228-2010, both the alloys according to the present invention and the alloys used for comparison were processed into standard test samples with a diameter of 10 mm and the tensile test was conducted at room temperature to test the mechanical performance of each alloy.

3. Cuttability

The cutting test was carried out on a horizontal lathe, and the shape of the chips was used to evaluate the cuttability of the alloys. Both the alloys according to the present invention and the alloys used for comparison were turned under the same condition, and the chips in fine and short needles will be considered as best, represented by "○"; the chips in fine short scrolls and fan-shape will be considered as good, represented by "Δ"; and the chips in long scrolls will be considered as bad, represented by "X".

The testing results of castability, mechanical performance and cuttability of some of the alloys according to the present invention and the alloys used for comparison were shown in table 3.

4. Dezincification Corrosion Resistance

The dezincification test was conducted according to AS2345, and three parallel samples with the sectional dimension of 10 mm×10 mm were obtained by cutting the thickest part of the casting made from the alloys according to the present invention and the alloys used for comparison. The inlayed test samples were placed in copper chloride solution with temperature controlled at 75±3° C. for corrosion at constant temperature for 24 hours, then the samples were cut into slices and made into metallographic microscope and the average depth of the dezincification layer was calibrated.

The results of the depth of the dezincification layer of the alloys according to the present invention and the alloys used for comparison were shown in tables 1 and 2.

TABLE 1

Components of Alloys According to the Present Invention (wt. %)

| Alloy | Cu | Al | Sn | Ni | Fe | Si | P | As | Pb | B | Zn | Zinc equivalent X (%) | Average depth of the dezincification layer (μm) |
|---|---|---|---|---|---|---|---|---|---|---|---|---|---|
| 1 | 62.40 | 0.19 | | | | | | 0.12 | 0.12 | | balance | 38.09 | 24 |
| 2 | 61.81 | 0.38 | | | | | | 0.12 | 0.14 | 5 ppm | balance | 39.22 | 34 |
| 3 | 64.39 | 0.76 | | | | | | 0.11 | 0.12 | | balance | 37.87 | 58 |
| 4 | 62.98 | 0.27 | | | | | | 0.09 | 0.16 | 12 ppm | balance | 37.73 | 4 |

TABLE 1-continued

| Components of Alloys According to the Present Invention (wt. %) | | | | | | | | | | | | | |
|---|---|---|---|---|---|---|---|---|---|---|---|---|---|
| Alloy | Cu | Al | Sn | Ni | Fe | Si | P | As | Pb | B | Zn | Zinc equivalent X (%) | Average depth of the dezincification layer (μm) |
| 5 | 63.10 | 0.24 | | | | | | 0.11 | 0.19 | 13 ppm | balance | 37.49 | 18 |
| 6 | 64.15 | 0.05 | | 0.16 | | | | 0.09 | 0.12 | 5 ppm | balance | 35.85 | 22 |
| 7 | 63.99 | 0.53 | | | 0.05 | | | 0.09 | 0.19 | 8 ppm | balance | 37.54 | 26 |
| 8 | 61.95 | 0.30 | 0.20 | | | | | 0.12 | 0.11 | 7 ppm | balance | 38.97 | 72 |
| 9 | 62.76 | 0.28 | 0.11 | | | | | 0.11 | 0.12 | 10 ppm | balance | 38.07 | 50 |
| 10 | 63.89 | 0.24 | 0.27 | | | 0.13 | 0.06 | 0.10 | 0.13 | 15 ppm | balance | 37.62 | 2 |
| 11 | 62.86 | 0.10 | 0.39 | | | 0.19 | 0.04 | 0.09 | 0.25 | 9 ppm | balance | 38.62 | 49 |

TABLE 2

| Components of Alloys Used for Comparison (wt. %) | | | | | | | | | |
|---|---|---|---|---|---|---|---|---|---|
| Alloy | Cu | Al | Sn | As | Pb | B | Zn | Zinc equivalent X (%) | Average depth of the dezincification layer (μm) |
| 1 (CuZn39Pb1Al) | 60.25 | 0.55 | | | 1.45 | 19 ppm | balance | 41.36 | 430 |
| 2 (CuZn35Pb2Al) | 63.91 | 0.67 | 0.25 | 0.10 | 1.83 | 17 ppm | balance | 38.20 | 61 |
| 3 | 62.19 | 0.72 | | 0.11 | 0.12 | | balance | 39.87 | 393 |
| 4 | 64.02 | 0.82 | | 0.11 | 0.12 | | balance | 38.22 | 105 |
| 5 | 61.10 | 0.19 | 0.31 | 0.12 | 0.05 | 14 ppm | balance | 39.48 | 260 |
| 6 | 62.10 | 0.65 | 0.12 | 0.12 | 0.13 | | balance | 39.83 | 239 |
| 7 | 63.5 | 0.81 | 0.11 | 0.11 | 0.12 | <5 ppm | balance | 38.94 | 157 |
| 8 | 61.45 | 0.59 | 0.09 | 0.12 | 0.12 | 9 ppm | balance | 40.20 | 189 |
| 9 | 61.91 | 0.43 | 0.21 | 0.09 | 0.15 | 12 ppm | balance | 39.39 | 109 |

It can be seen from table 1 and 2 that the average depth of the dezincification layer of the alloys according to the present invention are all less than 100 μm, which are significantly superior to Alloy 1 and Alloys 3-9 used for comparison, and it is revealed by the relationship between the zinc equivalent and the depth of the dezincification layer of the alloys according to the present invention and the alloys used for comparison that only when the content of Sn element in the alloys according to the present invention is less than 0.1 wt. % and the zinc equivalent meets 35%<equivalent weight of zinc X<39.5%, or the content of Sn element in the alloys according to the present invention is no less than 0.1 wt. % and the zinc equivalent meets 35%<equivalent weight of zinc X<39.0%, the average depth of the dezincification layer can be guaranteed within 100 μm.

TABLE 3

| The Castability and Mechanical Performance of Tested Alloys | | | | | | | |
|---|---|---|---|---|---|---|---|
| | Castability | | | Mechanical Performance | | | |
| Alloy Nos. | Volume Shrinkage | Linear shrinkage/% | Fluidity/mm | Tensile strength/MPa | Elongation/% | Brinell hardness | Cuttablity |
| Alloy 1 according to the present invention | ○ | 1.93 | 540 | 430 | 40 | 82 | x |
| Alloy 2 according to the present invention | ○ | 1.65 | 510 | 450 | 39 | 83 | Δ |
| Alloy 3 according to the present invention | Δ | 1.90 | 540 | 380 | 55 | 78 | x |
| Alloy 4 according to the present invention | ○ | 1.68 | 505 | 420 | 42 | 79 | x |
| Alloy 5 according to the present invention | ○ | 1.69 | 410 | 415 | 40.0 | 81 | x |

TABLE 3-continued

The Castability and Mechanical Performance of Tested Alloys

| Alloy Nos. | Castability | | | Mechanical Performance | | | |
|---|---|---|---|---|---|---|---|
| | Volume Shrinkage | Linear shrinkage/% | Fluidity/mm | Tensile strength/MPa | Elongation/% | Brinell hardness | Cuttablity |
| Alloy 6 according to the present invention | ○ | 1.88 | 520 | 365 | 56.5 | 78 | x |
| Alloy 7 according to the present invention | ○ | 1.94 | 395 | 369 | 57.0 | 76 | x |
| Alloy 8 according to the present invention | ○ | 1.73 | 550 | 410 | 54 | 80 | x |
| Alloy 9 according to the present invention | Δ | 1.70 | 550 | 355 | 53 | 69 | x |
| Alloy 10 according to the present invention | ○ | 1.60 | 550 | 372 | 57 | 78 | Δ |
| Alloy 11 according to the present invention | ○ | 1.58 | 550 | 380 | 58 | 79 | Δ |
| Alloy 1 used for comparison | ○ | 1.82 | 405 | 345 | 11.5 | 65 | ○ |
| Alloy 2 used for comparison | Δ | 1.80 | 430 | 335 | 19.0 | 76 | ○ |

It can be seen from table 3 that the castability of the alloys according to the present invention is comparable to that of lead DR brass, but as regard to mechanical performance, the tensile strength and elongation rate of the alloys according to the present invention are all higher than those of lead copper and lead DR brass.

It can be seen from all the above results that the alloys according to the present invention possess excellent dezincification corrosion resistance and comprehensive performance, and good castability and mechanical performance as well. Meanwhile, the release amount of toxic metal elements of the alloys according to the present invention into water meets the requirements of NSF and AS/NZS 4020 detecting standards, the alloys according to the present invention belong to environment-friendly materials. Therefore, the alloys according to the present invention have more extensive market application prospect.

The examples above are described for the purpose of illustration and not intend to limit the present invention. Within the spirit and the scope of protection defined by claims of the present invention, any modifications and changes made to the present invention fall into the scope of protection of the present invention.

What claimed is:

1. A dezincification-resistant brass alloy, wherein the brass alloy consists of 60-65 wt. % of Cu, 0.05-0.25 wt. % of Pb, 0.53-0.8 wt. % of Al, less than 0.1 wt. % of Sn, 0.05-0.16 wt. % of As, with the balance being Zn and unavoidable impurities.

2. The brass alloy according to claim 1, wherein the content of Cu in the brass alloy is: 62-64 wt. %.

3. The brass alloy according to claim 1, wherein the content of Pb in the brass alloy is: 0.1-0.25 wt. %.

4. The brass alloy according to claim 1, wherein the content of As in the brass alloy is: 0.08-0.12 wt. %.

5. A dezincification-resistant brass alloy, wherein the brass alloy consists of 60-65 wt. % of Cu, 0.05-0.25 wt. % of Pb, 0.53-0.8 wt. % of Al, less than 0.1 wt. % of Sn, 0.05-0.16 wt. % of As, and one or more elements selected from Ni, Fe, Si, P and B; wherein the content of Ni in the brass alloy is: 0.05-0.5 wt. %; the content of Fe is 0.02-0.2 wt. %; the content of Si is 0.03-0.3 wt. %; the content of P is 0.01-0.2 wt. %; and the content of B is less than 15 ppm; with the balance being Zn and unavoidable impurities.

6. The brass alloy according to claim 5, wherein the content of Ni in the brass alloy is: 0.05-0.2 wt. %; the content of Fe is 0.05-0.1 wt. %; the content of Si is 0.05-0.2 wt. %; the content of P is 0.05-0.1 wt. %; and the content of B is 5-15 ppm.

7. A dezincification-resistant brass alloy, wherein the brass alloy consists of 60-65 wt. % of Cu, 0.05-0.25 wt. % of Pb, 0.24-0.4 wt. % of Al, 0.27-0.4 wt. % of Sn, 0.05-0.16 wt. % of As, with the balance being Zn and unavoidable impurities.

8. The brass alloy according to claim 7, wherein the content of Cu in the brass alloy is: 62-64 wt. %.

9. The brass alloy according to claim 7, wherein the content of Al in the brass alloy is: 0.24-0.3 wt. %.

10. The brass alloy according to claim 7, wherein the content of Pb in the brass alloy is: 0.1-0.25 wt. %.

11. The brass alloy according to claim 7, wherein the content of Sn in the brass alloy is: 0.27-0.3 wt. %.

12. The brass alloy according to claim 7, wherein the content of As in the brass alloy is: 0.08-0.12 wt. %.

13. A dezincification-resistant brass alloy, wherein the brass alloy consists of 60-65 wt. % of Cu, 0.05-0.25 wt. % of Pb, 0.24-0.4 wt. % of Al, 0.27-0.4 wt. % of Sn, 0.05-0.16 wt. % of As, one or more elements selected from Ni, Fe, Si, P and B; the content of Ni in the brass alloy is 0.05-0.5 wt. %; the content of Fe is 0.02-0.2 wt. %; the content of Si is 0.03-0.3 wt. %; the content of P is 0.01-0.2 wt. %; and the content of B is less than 15 ppm; with the balance being Zn and unavoidable impurities.

14. The brass alloy according to claim 13, wherein the content of Ni in the brass alloy is 0.05-0.2 wt. %; the content of Fe is 0.05-0.1 wt. %; the content of Si is 0.05-0.2 wt. %; the content of P is 0.05-0.1 wt. %; and the content of B is 5-15 ppm.

15. A dezincification-resistant brass alloy, wherein the brass alloy consists of 60-65 wt. % of Cu, 0.05-0.25 wt. % of Pb, 0.53-0.8 wt. % of Al, 0.05-0.16 wt. % of As, with the balance being Zn and unavoidable impurities.

16. A dezincification-resistant brass alloy for casting, wherein the brass alloy consists of 60-65 wt. % of Cu, 0.05-0.25 wt. % of Pb, 0.53-0.8 wt. % of Al, 0.05-0.16 wt. % of As, one or more elements selected from Ni, Fe, Si, P and B; the content of Ni in the brass alloy is: 0.05-0.5 wt. %; the content of Fe is 0.02-0.2 wt. %; the content of Si is 0.03-0.3 wt. %; the content of P is 0.01-0.2 wt. %; and the content of B is 5-15 ppm, with the balance being Zn and unavoidable impurities.

* * * * *